United States Patent [19]

Levinson

[11] 4,033,493

[45] July 5, 1977

[54] PIN WHEEL FEEDING DEVICE

[75] Inventor: Leo Levinson, Berkeley, Calif.

[73] Assignee: Xerox Corporation, Stamford, Conn.

[22] Filed: Feb. 23, 1976

[21] Appl. No.: 660,556

[52] U.S. Cl. ..... 226/81; 226/87

[51] Int. Cl.[2] ..... G03B 1/24

[58] Field of Search ..... 226/76, 78, 81, 87, 226/75

[56] References Cited

UNITED STATES PATENTS

| | | | |
|---|---|---|---|
| 2,000,649 | 5/1935 | Sherman | 226/81 X |
| 2,102,651 | 12/1937 | Sherman | 226/81 X |
| 2,400,226 | 5/1946 | Euth | 226/81 X |

*Primary Examiner*—Richard A. Schacher

*Attorney, Agent, or Firm*—M. J. Colitz; T. J. Anderson; B. P. Smith

[57] ABSTRACT

A pin wheel feeding device includes a housing capable of being rotated about an axis. A plurality of substantially identical pins are disposed within the housing in respective alignment with a plurality of openings. Each pin includes a pair of opposing guide members. A cam member disposed within the housing is capable of being fixed in position relative to the housing. The cam member has a track formed thereon with which each of the pins is engaged with the pair of guide members thereof being located on either side of the track. The width of the track at first, second and third segments thereof is substantially coextensive with the locus of points traced by the closest adjacent points on the pair of guide members of each pin during movement of the pins along the first, second and third segments of the track.

12 Claims, 9 Drawing Figures

PIN WHEEL FEEDING DEVICE

BACKGROUND OF THE INVENTION

This invention relates to feeding devices and, more particularly, to a pin wheel feeding device of the type generally used to positively feed marginally punched record material past a work station.

Pin wheel feeding devices of the above type have been known for quite some time (see, for example, U.S. Pat. Nos. 2,128,924 and 2,815,672). Due to the speed and versatility of modern day computers and computer output printers, contemporary pin wheel feeding devices should have the characteristics of precision and reversibility. Reversibility is highly desirable in printing machines when used to plot graphs, curves, charts and the like.

The pin wheel feeding devices disclosed in the aforementioned patents are not designed with a feed reversal capability. Feed reversal requires that pins project from the pin wheel housing at two locations, i.e. one adjacent the point of entry of the record material onto the housing, usually forming part of or connected to a rotatable platen, and one adjacent the point of exit of the record material from the housing-platen. The former set of pin projections feed in the forward direction and the latter in the reverse direction. It is clear that if only the former set of pin projections were present, as is the case in the above mentioned patents, the record material might lose tautness and be lifted off the platen during reverse feeding. This, of course, is entirely unacceptable.

The predominance of pin wheel feeding devices currently in use today, whether having a reversal capability or not, are generally characterized by a cylindrical housing capable of being rotated about its axis, the housing having a peripheral wall containing a plurality of openings formed therein, each opening lying along a radial line extending from said axis. A plurality of substantially identical pins are disposed within the housing in respective alignment with the plurality of openings, each pin capable of being moved along the respective radial line from a first position in which it is substantially entirely located within the housing to a second position in which it projects from the respective aligned opening. Each pin includes a pair of opposing guide members, the point on each guide member located closest the opposing guide member lying substantially along the respective radial line. A cam member is disposed within the housing and is capable of being fixed in position relative to the housing, the cam member having a track formed thereon with which each of the pins is engaged with the pair of guide members thereof being located on either side of the track. The pins follow the path of the track during rotation of the housing relative to the cam member. The track has a first segment capable of maintaining a pin engaged therewith at its first position, a second segment capable of maintaining a pin engaged therewith at its second position, and a third segment intermediate and contiguous with the first and second segments for enabling a pin engaged therewith to move between its first and second positions during rotation of the housing.

Reversible pin wheel feeding devices of the above type are further characterized in that the cam member has a track including a pair of first segments as above defined. The cam member is so mounted such that the pair of first segments are respectively adjacent the entry and exit locations of the record medium so that the pins will project from the housing at these locations.

A major problem with this type of reversible pin wheel feeding device stems from the fact that there is "lost motion" of the pins engaged with the first segments of the cam track. More specifically, the distance between the guide members on each pin engaged with a first segment is larger than the width of such first segment,, thereby leaving a space between the first segment and one of the pair of guide members, depending upon the direction of rotation of the housing. When this direction is reversed, the pin will not start following the track until such one guide member is moved into contact with the track, thereby resulting in a "lost motion". Lost motion is inconsistent with the precision requirements of most contemporary high speed printers and can lead to mishandling and damaging of the record medium.

The reason the cam track's first and second segments are narrower than the spacing between the guide members is due to the fact that the track is formed of a uniform width, which width is determined by the minimum width required for free movement of the pins along the third segment, above defined. More specifically, on such third segment, a pin is changing positions and thus is no longer moving along an arcuate path at a predetermined radius, which is normally the case with movement along the first and second segments. Nonetheless, the guide members on the pin continue to be aligned with the respective radial line from the axis of rotation of the housing, thereby decreasing the requisite width of the track at such third segment in order to allow free movement.

It would be desirable, therefore, to provide a pin wheel feeding device of the above general type where lost motion is substantially reduced during reversal of rotation, thereby making the device especially desirable for reversible feeding.

SUMMARY OF THE INVENTION

In accordance with the present invention, a pin wheel feeding device of the above general type is provided wherein the width of the cam track at its first, second and third segments is made substantially coextensive with the locus of points traced by the closest adjacent points on the pair of guide members of each pin during movement of the pins along the first, second and third segments of the track. In this manner, so-called "lost motion" is substantially reduced.

In the preferred embodiment, the cam track is a closed path including a pair of opposing first segments, a pair of opposing second segments and two pairs of opposing third segments. Further, the track is preferably symmetrical on either side of any plane which includes the axis of rotation of the housing therein. The cam can, therefore, be used as part of a reversible pin feed platen assembly on either the left or right side of the platen.

These and other aspects and advantages of the present invention will be more completely described below with reference to the accompanying drawings.

DESCRIPTION OF THE PREFERRED EMBODIMENT

Figure 1:
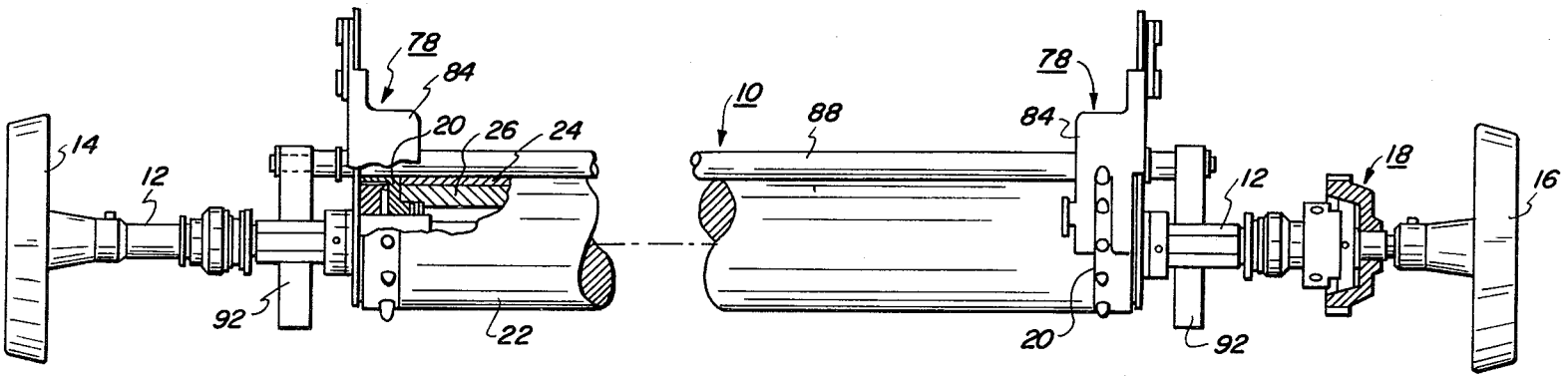
FIG. 1 is a side elevation view, partly broken away and in a section, of a reversible pin feed platen assembly including a pair of pin wheel feeding devices of the present invention.

Referring to FIG. 1, a reversible pin feed platen assembly 10 is shown comprising a rotatable shaft 12 having mounted at either end a pair of knobs 14 and 16 for manually turning the shaft 12. As is conventional, knob 14 is fixed directly to the shaft 12 and knob 16 is mounted to the shaft for movement axially of the shaft between first and second positions. When in a first position, a gear-drive assembly 18 mounted about the shaft 12 adjacent the knob 16 is engaged with the shaft so that a motor-gear arrangement (not shown) coupled to the gear-drive assembly 18 controls automatic rotation of the shaft 12. When in a second position, the knob 16 disengages the gear-drive assembly 18 from the shaft 12 so that manual rotation of the knobs 14 and 16 will cause a corresponding manual rotation of the shaft 12.

The gear-drive assembly 18 forms no part of the present invention and thus will not be described in detail herein. It should be noted, however, that such assembly is of conventional variety and manufacture and details thereof may be obtained through a review of the HyType I serial printer marketed by Diablo Systems, Inc. of Hayward, California.

Again referring to FIG. 1, a pair of identical pin wheel feeding devices 20 of the present invention are also mounted to the shaft 12 on either side of a conventional circularly cylindrical platen 22 located substantially intermediate the length of the shaft 12. The platen 22 is formed of a layer of resilient material 24, such as hard rubber, disposed about a support backing 26, which is preferably metallic, such as aluminum. The specific manner by which the pin wheel feeding devices 20 and platen 22 are mounted to the shaft 12 will be described in detail below.

Figure 2:
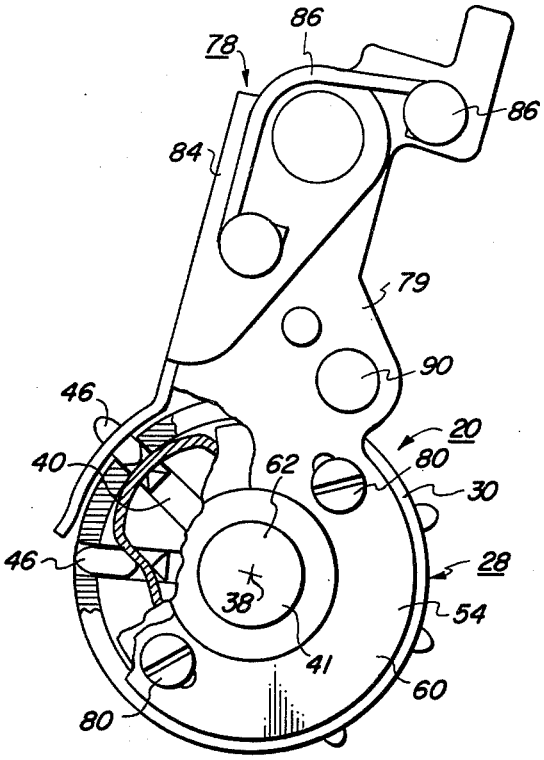
FIG. 2 is an end elevation view, partly broken away and in section, of one of the pin wheel feeding devices shown in FIG. 1.
Figure 3:
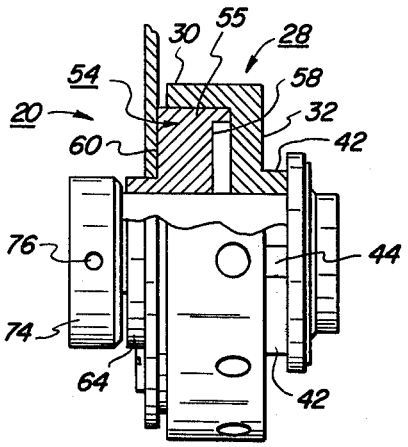
FIG. 3 is a side elevation view, partly broken away and in section, of the pin wheel feeding device of FIG. 2 with the pins therein deleted for clarity of the remaining parts.
Figure 6:
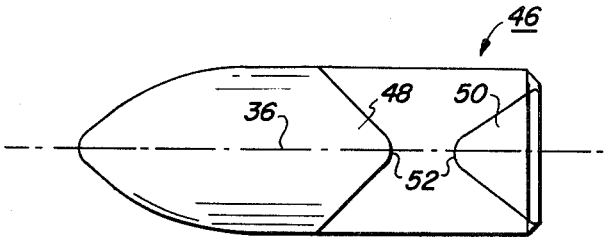
FIG. 6 is a top plan view of a pin used in the pin wheel feeding device of FIGS. 2 and 3.
Figure 7:
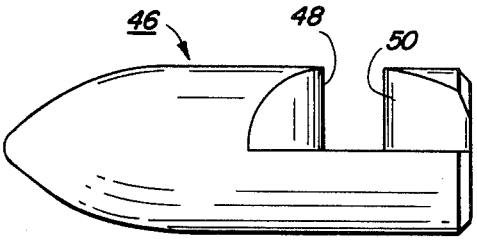
FIG. 7 is a side elevation view of the pin of FIG. 6.
Figure 8:
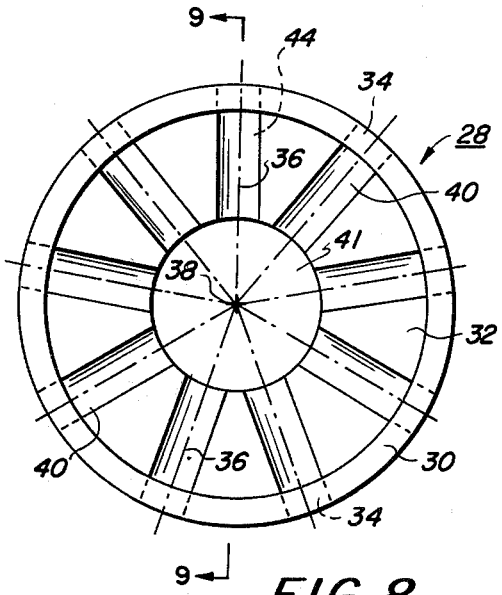
FIG. 8 is an end elevation view of the housing forming part of the pin wheel feeding device of FIGS. 2 and 3.
Figure 9:
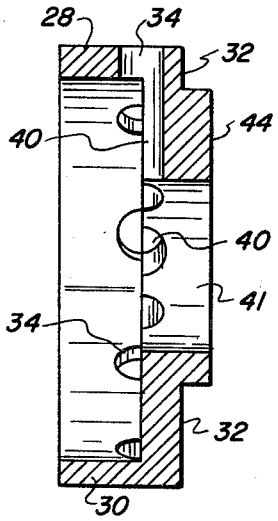
FIG. 9 is a side cross-sectional view of the housing of FIG. 8 taken along lines 9—9 of FIG. 8.

Reference is now had to FIGS. 2–9 for a description of the pin wheel feeding devices 20. Since the two devices 20 are identical in manufacture, only one will be described. As best shown in FIGS. 3, 8 and 9, each pin wheel feeding device 20 includes a circularly cylindrical housing 28 having a peripheral wall 30. The peripheral wall 30 is formed as an annular flange extending outwardly from an end wall 32 of the housing 28 and includes a plurality of spaced openings 34 formed therein. Each opening 34 lies along a respective radial line 36 extending from the axis of rotation 38 of the housing 28 and, more particularly, the center of each opening 34 intersects the respective radial line 36.

As best shown in FIGS. 2, 8 and 9, the outer surface of the end wall 32 has a plurality of grooves 40 formed therein in respective alignment with the plurality of openings 34 and extending between such openings and a central circular opening 41 formed through the wall 32. The center line of each groove is coincident with the respective radial line 36. Referring to FIGS. 3, 8 and 9, the end wall 32 has an annular lip 42 extending inwardly, i.e. in the direction toward the opposing feeding device 20 at the other end of the platen 22. Extending from the lip 42 is a key 44 adapted to be engaged in a keyway (not shown) formed in the metal backing 26 of the platen 22. In this manner, rotation of the housings 28 of the pair of feeding devices 20 will cause a corresponding rotation of the platen 22.

Referring now to FIGS. 2, 6 and 7, a plurality of substantially identical pins 46 are disposed within respective grooves 40 in the housing 28. Each pin is capable of being moved along the respective radial line 36 (FIG. 8) from a first position in which it is entirely located within the housing 28 to a second position in which it projects a predetermined distance from the housing out of the respective aligned opening 34. Each pin 46 has formed thereon a pair of opposing guide members 48 and 50. The guide members are preferably each generally triangular shaped cut-out portions of the pin with the apex 52 of each triangular portion lying substantially along the respective radial line 36.

As best shown in FIGS. 2–5, a cam member 54 is disposed within the housing 28 and is capable of being fixed in position relative to the housing in a manner to be described in more detail below. The cam member 54 includes a main cylindrical body portion 55 having an inner surface 58 and an outer surface 60. An elevated track 56 projects a predetermined distance from the inner surface 58 and is adapted to contact the inner wall 32 of the housing 28 (see FIG. 3) and the cut-out or notch portion of each pin 46 disposed in the housing so that the guide members 48 and 50 of each pin will be disposed on either side of the track (see FIG. 2). In this respect, the pins 46 are disposed in the grooves 40 with their guide members 48 and 50 facing outwardly, i.e. away from the platen 22.

The cam member 54 also has a central opening 62 extending therethrough, the opening 62 being of substantially identical size to and coaxially aligned with the central opening 41 in the housing 28. Further, an annular lip 64 preferably extends outwardly from the outer surface 60, the lip 64 having an inner diameter equal to the diameter of the oening 62. The purpose of lip 64 and opening 62 will be described in more detail below in connection with a description of the manner in which the pin wheel feeding devices 20 are mounted to the shaft 12.

Referring again to FIGS. 2 and 4, it should be clear that as the housing 28 and pins 46 rotate relative to the fixed cam member 54, the pins will be caused to follow the track 56 and thereby be moved radially with respect to the axis of rotation 38 of the housing between the first and second positions above defined. In this respect, it is noted that the track 56 is preferably a closed path having a pair of opposing first segments 66*a* and 66*b*, a pair of opposing second segments 68*a* and 68*b* and two pairs of opposing third segments 70*a*–70*b* and 72*a*–72*b*, respectively. The segments are all set up such that the track 56 is symmetrical on either side of any plane including the axis 38 of the housing therein, such axis being coaxial with the axis of the cam member 54. This symmetry is preferred so that identical cam members 54 may be used in both left-hand and right-hand pin wheel feeding devices 20 (see FIG. 1).

Figure 4:
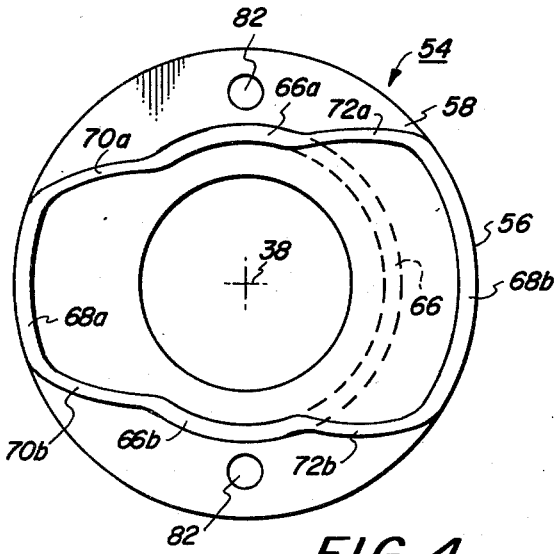
FIG. 4 is an end elevation view of the cam member forming part of the pin wheel feeding device of FIGS. 2 and 3.
Figure 5:
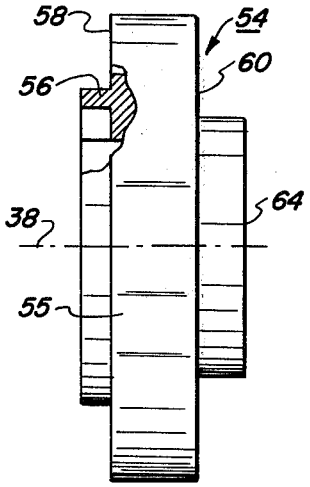
FIG. 5 is a side elevation view, partly broken away and section, of the cam member of FIG. 4.

Referring now mpore particularly to the track 56 as shown in FIGS. 2 and 4, it will be noted that the cam member 54 is desirably fixed in a position with the second segment 68*a* facing forwardly and upwardly and the opposing second segment 68*b* (not shown in FIG. 2) facing rearwardly and downwardly. Pins 46 engaged with such second segments 68*a* and 68*b* will be located at their second positions above defined, i.e. projecting outwardly from the housing 28 in order to grasp corresponding marginal holes formed in a record material (not shown) to be transported over the platen by the pin wheel feeding devices 20. The second segments 68*a* and 68*b* preferably follow an arcuate path at a predetermined radius from the axis 38.

Pins 46 projecting from the second segment 68*a* are designed to feed marginally punched record material (not shown) in a forward direction, while pins 46 projecting from the second segment 68*b* are designed to feed such record material in a reverse direction. The extent of second segment 68*a* is preferably smaller than the maximum possible extent, as evidenced by the extent of the second segment 68*b*, so that the pins 46 projecting from the segment 68*a* will be retracted into the housing 28 before they reach the location of a card guide (not shown) normally included on the type of printers with which the reversible pin feed platen assembly 10 is likely to be used.

Pins 46 engaged with the first segments 66*a* and 66*b* will be located at their first positions above defined, i.e. disposed substantially entirely within the housing 28 and pins engaged with the third segments 70*a*, 70*b*, 72*a* and 72*b* will be in transition between their respective first and second positions. The first segments 66*a* and 66*b* also preferably follow an arcuate path at a predetermined radius shorter than the predetermined radius for the second segments 68*a* and 68*b*.

As explained earlier, prior art reversible pin wheel feeding devices using cam members similar to cam member 54, have formed the cam track of uniform width over its entire extent, i.e. the first, second and third segments are all of the same width and this width is necessarily no larger than that required to allow the free transgression of the pins over the third segments. In this regard, it will be noted that the third segments do not follow an arcuate path along a radius from the axis 38. Because of this relationship, the width of the track is necessarily substantially less than the distance between the apexes 52 of the guide members 48 and 50. The result is that pins engaged with the first and second segments will experience some "lost motion" during feed reversal.

In accordance with the present invention, and with reference to FIG. 4, so-called "lost motion" has been substantially reduced, if not eliminated, by tailoring the width of the track 56 so that the first, second and third segments thereof are substantially coextensive with the locus of points traced by the two apexes 52 on the guide members 48 and 50 of each pin during movement of the pins along the track. In this manner, and except for normal mechanical clearances, the guide members 48 and 50 of each pin will be engaged with the track on either side thereof regardless of what segment of the track the pin is on (see FIG. 2).

Referring again to FIGS. 1–3, the specific manner by which the feeding devices 20 are mounted will be described. As noted best in FIGS. 1 and 3, a bearing 74 is disposed through the openings 41 and 62 in the housing and cam member, respectively. The bearing 74 is divided into two segments (not shown) of slightly different diameter in order for the bearing to be snuggly engaged with the housing 28 and movable relative to the cam member 54. The inner end of the bearing 74 has a threaded opening 76 in which a set screw is adapted to be screwed to hold fast the bearing against the shaft 12 and thereby enable the bearing 74, housing 28 and platen 22 to rotate upon rotation of the shaft 12.

A clip assembly 78 is secured to the outer surface 60 of each cam member 54 as, for example, by screws 80 which are screwed through openings (not shoen) in an arm 79 of the assembly 78 into aligned threaded openings 82 in the main body portion 55 of the cam member 54 (see FIG. 4). A guide 84 is pivotably mounted to the arm 79 about a pivot pin 86. The guide 84 is spring loaded, preferably by a wire spring 86, so as to be biased in a first position adjacent the respective pin wheel feeding device 20 (as shown in FIGS. 1 and 2) in order to prevent the record material from prematurely disengaging from the pins 46. Additionally, the spring 86 biases the guide 84 in a second position (not shown) pivoted upwardly so as to enable marginally punched record material to be engaged with the devices 20.

Referring specifically to FIGS. 1 and 2, a position control rod 88 is mounted to the pair of clip assmeblies 78 by having both ends of the rod extending through aligned openings 90 in the respective arms 79. A pair of clips 92 are mounted on the ends of the rod 88 and are adapted to be coupled to a respective pair of members (not shown) fixed to the frame of the printing machine (not shown). Since the cam members 54 are fixed to the arm, it will be apparent that once the rod 88 is fixed in position by the coupling action of the clips 92, the cam members 54 will be fixed in position. Of course, the positional relationship between the rod 88, clips 92 and respective coupling members on the printing machine is such that the cam members 54 are properly positioned relative to the location of their track segments so that the pins 46 will project from the housings 28 at the locations shown in FIG. 2, thereby enabling proper forward and reverse pin feeding.

Although the present invention has been described with respect to a presently preferred embodiment, it will be appreciated by those skilled in the art the various modifications, substitutions, etc. may be made without departing from the spirit and scope of the invention as defined by the following claims. As an example, and referring to FIG. 4, the present invention may be applied to uni-directional feeding devices in addition to reversible feeding devices. In this respect, the cam track can be formed with segments 72*a*, 68*b* and 72*b* deleted in favor of a single first segment 66 extending arcuately between the third segments 70*a* and 70*b* along the same radius as first segments 66*a* and 66*b* of FIG. 4. As another example, the track 56 need not be symmetrical in the manner above defined, although such is clearly preferred when using both left and right pin wheel feeding devices 20. As yet another example, the cam members 54 need not be fixed in position relative to their respective housings by the control rod 88 and clips 92. Any suitable means may be employed for preventing movement of the cam member when fixed in a desired position relative to the housing.

What is claimed is:

1. A pin wheel feeding device comprising:

a housing capable of being rotated about an axis and having a peripheral wall containing a plurality of oenings formed therein, each opening lying along a radial line extending from said axis;

a plurality of substantially identical pins disposed within said housing in respective alignment with said plurality of openings, each pin capable of being moved along the respective radial line from a first position in which it is substantially entirely located within said housing to a second position in which it projects a predetermined distance from the respective aligned opening, each pin including a pair of opposing guide members, the point on each guide member located closest the opposing guide member lying substantially along the respective radial line; and a cam member disposed within said housing and capable of being fixed in position relative to said housing, said cam member having a track formed thereon with which each of said pins is engaged with the pair of guide members thereof being located on either side of said track, said pins following the path of said track during rotation of said housing relaive to said cam member, said track having a first segment capable of maintaining a pin engaged therewith at said first position, a second segment capable of maintaining a pin engaged therewith at said second position, and a third segment intermediate and contiguous with said first and second segments for enabling a pin engaged therewith to move between said first and second positions during rotation of said housing, the width of said track at said first, second and third segments being substantially coextensive with the locus of points traced by the closest adjacent points on the pair of guide members of each pin during movement of the pins along the first, second and third segments of said track.

2. The pin wheel feeding device of claim 1, wherein said first segment follows an arcuate path at a predetermined radius from said axis.

3. The pin wheel feeding device of claim 1, wherein said second segment follows an arcuate path at a predetermined radius from said axis.

4. The pin wheel feeding device of claim 1, wherein said first segment follows an arcuate path at a first predetermined radius from said axis and said second segment follows an arcuate path at a second predetermined radius from said axis, said first predetermined radius being smaller than said second predetermined radius.

5. The pin wheel feeding device of claim 1, wherein said track has a pair of opposing first segments each capable of maintaining a pin engaged therewith at said first position.

6. The pin wheel feeding device of claim 1, wherein said track has a pair of opposing second segments each capable of maintaining a pin engaged therewith at said second position.

7. The pin wheel feeding device of claim 1, wherein said track has a pair of opposing first segments each capable of maintaining a pin engaged therewith at said first position, a pair of opposing second segments each capable of maintaining a pin engaged therewith at said second position, and two pairs of opposing third segments each disposed intermediate and contiguous a first segment and a second segment for enabling a pin engaged therewith to move between said first and second positions during rotation of said housing.

8. The pin wheel feeding device of claim 7, wherein each first segment follows an arcuate path at a first predetermined radius from said axis and each second segment follows an arcuate path at a second predetermined radius from said axis, said first predetermined radius being smaller than said second predetermined radius.

9. The pin wheel feeding device of claim 1, wherein said track is symmetrical on either side of any plane which includes the axis of rotation of the housing therein.

10. A pin feed platen assembly for feeding marginally punched record material past a work station comprising:

a rotatable shaft;

a cylindrical platen coupled to said shaft for rotation therewith; and at least one pin wheel feeding device coupled to said shaft adjacent said platen for feeding marginally punched record material disposed about said platen, said at least one pin wheel feeding device comprising a housing capable of being rotated about an axis and having a peripheral wall containing a plurality of openings formed therein, each opening lying along a radial line extending from said axis; a plurality of substantially identical pins disposed within said housing in respective alignment with said plurality of openings, each pin capable of being moved along the respective radial line from a first position in which it is substantially entirely located within said housing to a second position in which it projects a predetermined distance from the respective aligned opening each pin including a pair of opposing guide members, the point on each guide member located closest the opposing guide member lying substantially along the respective radial line; and a cam member disposed within said housing and capable of being fixed in position relative to said housing, said cam member having a track formed thereon with which each of said pins is engaged with the pair of guide members thereof being located on either side of said track, said pins following the path of said track during rotation of said housing relative to said cam member, said track having a first segment capable of maintaining a pin engaged therewith at said first position, a second segment capable of maintaining a pin engaged therewith at said second position, and a third segment intermediate and contiguous with said first and second segment for enabling a pin engaged therewith to move between said first and second positions during rotation of said housing, the width of said track at said first, second and third segments being substantially coextensive with the locus of points traced by the closest adjacent points on the pair of guide members of each pin during movement of the pins along the first, second and third segments of said track.

11. The pin feed platen assembly of claim 10, wherein there are two substantially identical pin wheel feeding devices coupled to said shaft respectively adjacent either end of said platen.

12. The pin feed platen assembly of claim 10, wherein said track is symmetrical on either side of any plane which includes the axis of rotation of the housing therein.

* * * * *